United States Patent [19]

Straitz, III

[11] 4,120,638

[45] Oct. 17, 1978

[54] IGNITION SYSTEM FOR FLARES

[75] Inventor: John F. Straitz, III, Meadowbrook, Pa.

[73] Assignee: Combustion Unlimited Incorporated, Elkins Park, Pa.

[21] Appl. No.: 815,991

[22] Filed: Jul. 15, 1977

[51] Int. Cl.[2] ..... F23D 13/20

[52] U.S. Cl. ..... 431/15; 431/121; 431/202; 431/283

[58] Field of Search ..... 431/202, 278, 283, 121, 431/15

[56] References Cited

U.S. PATENT DOCUMENTS

| | | | |
|---|---|---|---|
| 2,460,016 | 1/1949 | Kuhn | 431/202 |
| 2,767,784 | 10/1956 | Dean | 431/202 |
| 3,307,608 | 3/1967 | Cowan | 431/15 |
| 3,741,713 | 6/1973 | Reed | 431/202 |
| 3,833,336 | 9/1974 | Ray | 431/202 |
| 3,932,111 | 1/1976 | Liknes et al. | 431/202 |
| 4,025,281 | 5/1977 | Lapp | 431/202 |
| 4,026,267 | 5/1977 | Coleman | 126/270 |

*Primary Examiner*—Carroll B. Dority, Jr.
*Attorney, Agent, or Firm*—Zachary T. Wobensmith, 2nd; Zachary T. Wobensmith, III

[57] ABSTRACT

An ignition system for flares is described particularly suitable for use in remote areas with limited facilities and which includes as components a power source and specifically storage batteries with a solar battery for recharging and having an associated gasoline engine driven blower for supplying air for ignition, together with an ignition panel adapted for ready connection to a source of fuel gas, to the blower, to the power source, to the stack pilot, to the pilot ignitor and if desired to the flare header for purge gas supply. The panel preferably includes a manually oprable push button for an ignition spark plug, has indicators of pilot operation and has manual control of the delivery of fuel gas for ignition, for use as pilot gas and for use as purge gas. A thermocouple is provided at the pilot for control of indicating lamps indicative of pilot operation or non-operation as well as purge failure.

12 Claims, 3 Drawing Figures

IGNITION SYSTEM FOR FLARES

BACKGROUND OF THE INVENTION

1. Field of the Invention

This invention relates to an ignition system for flares which is particularly suitable for remote areas where electricity and compressed air are not readily available but where it is necessary to operate a flare for burning of combustible waste gas.

2. Description of the Prior Art

Various ignition systems for flares have been proposed for igniting combustible gas from industrial and other processes and including oil refineries. In permanent installations such systems are provided to meet the needs for continuous operation.

In ignition systems it is also common to employ controls for the delivery of pilot gas, to provide a flame to ignite the waste combustible gas and for the delivery of air and combustible gas to provide a flame for igniting the pilot. One such system is shown in my prior application for Letters Patent, filed Feb. 6, 1976, Ser. No. 655,852.

No ignition system has heretofore been available for use with flares in remote areas where electricity and/or compressed air are not readily available although fuel gas is available for operating pilot and ignitors and, if desired, for purge gas.

SUMMARY OF THE INVENTION

In accordance with the invention an ignition system for flares is provided which is particularly suitable for use in remote areas where electricity or compressed air are not readily available but where adequate provisions must be made for igniting combustible waste gas in a flare. The system includes a self-contained gasoline engine driven blower and an electric power source with provisions for manual control of the delivery of air and fuel gas for ignition, for the delivery of purge gas for purging the flare and for the delivery of pilot gas for pilots at the discharge end of the flare.

It is the principal object of the present invention to provide an ignition system for flares which is simple in construction, and is readily operable by relatively unskilled persons.

It is a further object of the present invention to provide an ignition system for flares in which a solar battery is provided for energizing storage batteries utilized as a source of electric energy for operation of the system.

It is a further object of the present invention to provide an ignition system for flares which can, if desired, be moved from place to place as required by separation of readily separable components and without the necessity for dismantling.

Other objects and advantageous features of the invention will be apparent from the description and claims.

DESCRIPTION OF THE DRAWINGS

The nature and characteristic features of the invention will be more readily understood from the following description taken in connection with the accompanying drawings forming part hereof in which.

Figure 1:
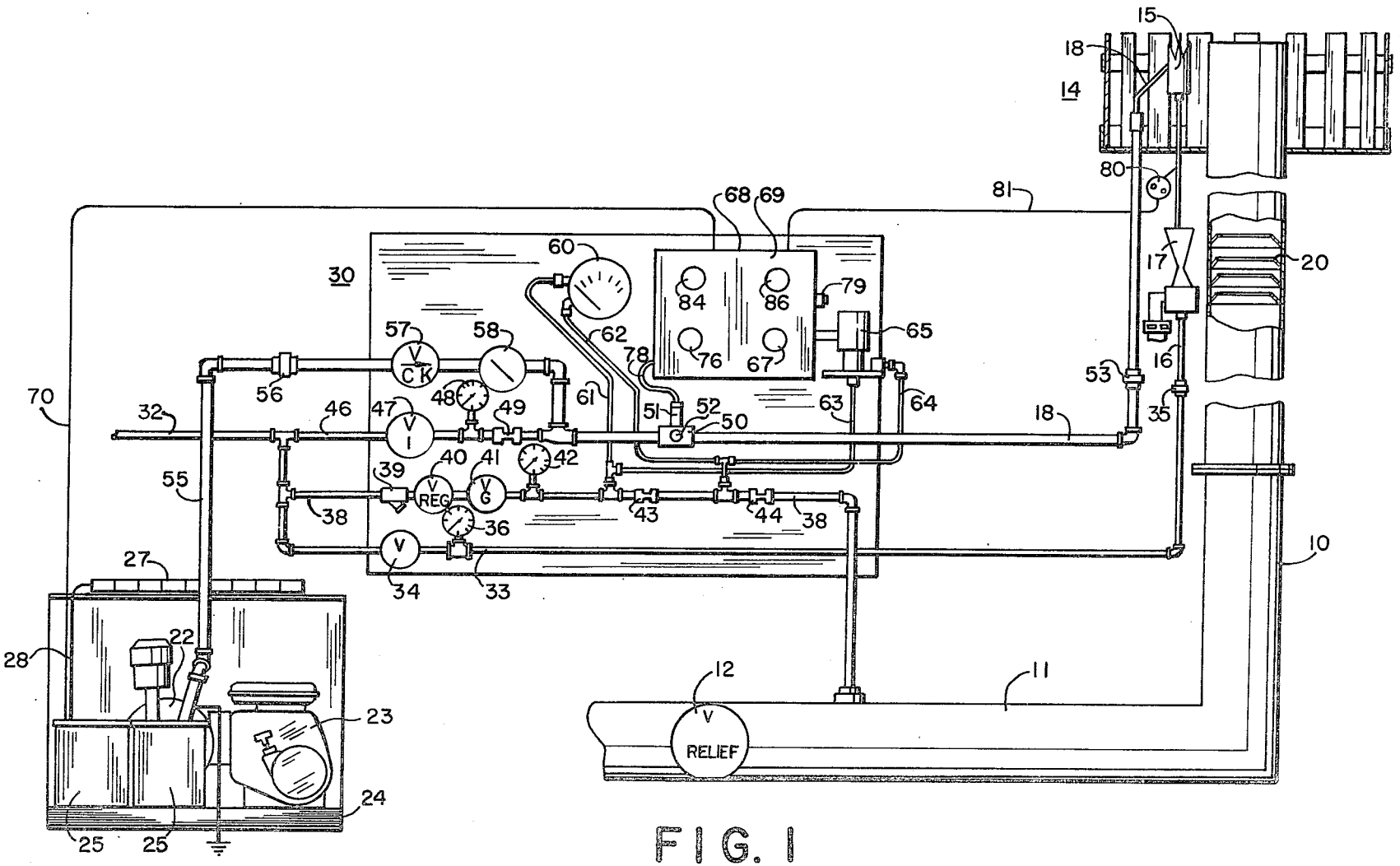
FIG. 1 is a diagrammatic view of an ignition system for flares in accordance with the invention.
Figure 3:
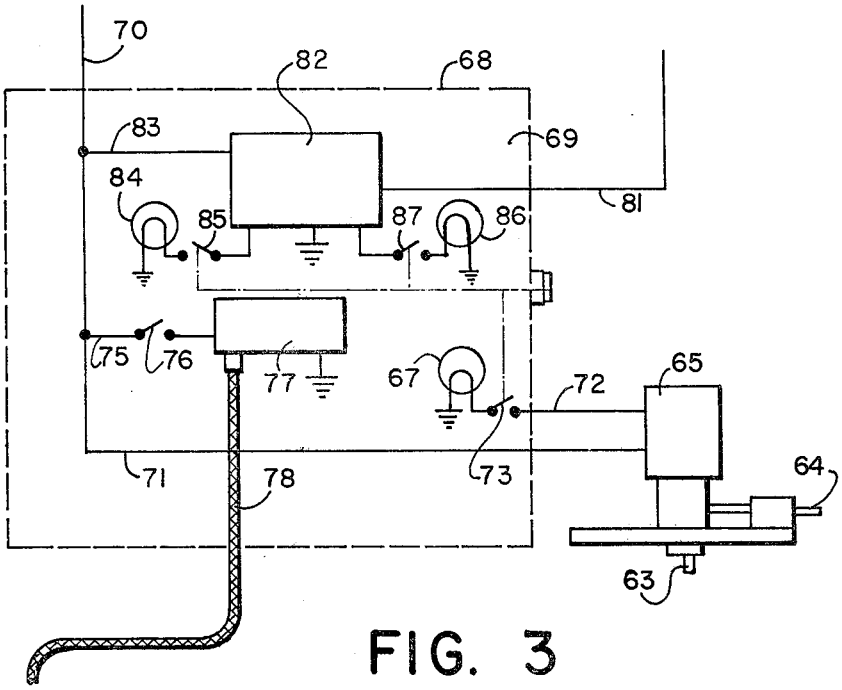
FIG. 3 is a diagrammatic view, enlarged, of a portion of the control system used in connection with the invention.
Figure 2:
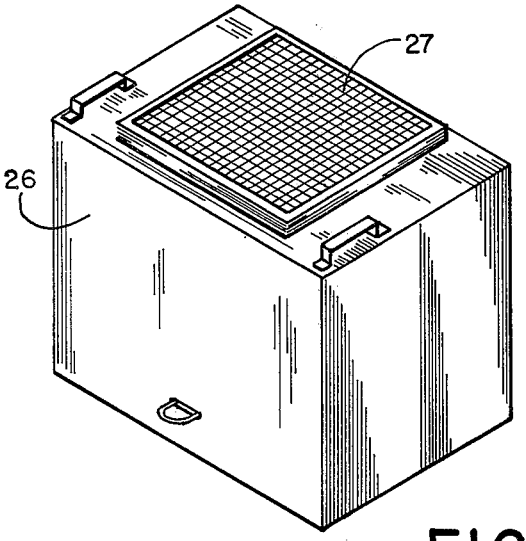
FIG. 2 is a perspective view of the separable cover for the air and electric supply utilized with the system and having a solar battery mounted thereon.

It should, of course, be understood that the description and drawings herein are illustrative merely and that various modifications and changes can be made in the structure disclosed without departing from the spirit of the invention.

Like numerals refer to like parts throughout the several views.

DESCRIPTION OF THE PREFERRED EMBODIMENT

Flares for the disposal by combustion of waste combustible gases can be vertical, horizontal or inclined.

For purposes of illustration of the invention, a flare stack 10 is shown, indicated as vertical, and with a flare header 11 connected thereto for supplying waste combustible gas to be burned. The flare header 11 preferably has a relief valve 12 therein to permit the waste combustible gas to be delivered through the header 11 and stack 10 for burning.

The flare stack 10 is shown also merely by way of illustration as being provided at the discharge end with a hollow cylindrical slotted wind shield 14 closed at the bottom to reduce the wind effect at the end of the stack 10. Disposed within the wind shield 14 is a pilot 15 to which a gas-air mixture is provided supplied by a pilot gas pipe 16 and through a venturi 17 where air is admixed for burning of gas at the pilot 15. The pilot 15 also has an ignitor pipe 18 connected thereto for the delivery of flame to the pilot for igniting the gas at the pilot 15.

The stack 10, close to the discharge end, is preferably provided with a fluidic seal 20 as shown in my U.S. Pat. No. 3,730,673, for permitting free outward flow of gas but for preventing inward flow within the stack 10.

A source of air under pressure is provided and for this purpose a blower 22 driven by a gasoline engine 23 is employed, preferably mounted on a base 24, which base 24 may also have mounted thereon storage batteries 25 which serve as an electric power source. A removable cover 26 is provided. The top wall of the cover 26 preferably has mounted thereon a plurality of interconnected solar batteries 27 to provide input by conductor 28 to the storage batteries 25. The solar batteries 27 can be activated by exposure to the sun at the place of use of the system.

The unit comprising the blower 22, gasoline engine 23, storage batteries 25 and the cover 26 with the solar batteries 27 is one component of the system and is available for movement to the place of use.

A panel 30 is provided for the mounting of indicators, control valves and other equipment, as hereinafter described and is also available for movement as a unit to the place of use.

A connection 32 to a source of combustible fuel gas is provided which is connected by a pipe 33 through a manually operable pilot gas control valve 34 and a detachable coupling 35 to the pilot gas pipe 16 carried on the stack 10. A pressure gage 36 is provided in the pipe 33 beyond the valve 34 for observation of the pressure prevailing in the supply pipes 33 and 16 to the pilot 15.

A pipe 38 can also be provided connected to the pipe 32 for the supply of purge gas to the header 11 and has interposed therein, and carried on the panel 30, a strainer 39, a pressure regulator 40, a manually controlled purge gas valve 41 and a pressure gage 42.

Spaced metering orifices 43 and 44 are also provided in the pipe 38 for purposes to be explained.

A pipe 46, connected to the pipe 32, is provided and is connected through a manually operable ignition gas valve 47. The pipe 46 is carried on the panel 30, and is provided with a pressure gage 48 and a metering orifice 49 and extends to an ignition coupling 50. The coupling 50 has an igniting spark plug 51 and a sight port 52. The igniter pipe 18 extends from the ignition coupling 50 to the pilot 15 through a detachable coupling 53.

The blower 22 is connected by a pipe 55 having a detachable coupling 56, a check valve 57 for preventing backflow and a butterfly valve 58 for controlling the air flow. The pipe 55 is connected to the gas pipe 46 beyond the metering orifice 49 for mixing air with the fuel gas to provide an explosive mixture.

In order to measure the flow in the purge gas pipe 38 a differential pressure gage 60, mounted on the panel 30, is provided having a connection 61 to the pipe 38 upstream of the metering orifice 43 and a downstream connection 62 upstream of the metering orifice 44 with connections 63 and 64 to a differential pressure switch 65. The switch 65 controls a purge failure lamp 67 contained within a control box 68 mounted on the panel 30, the lamp 67 being visible through the front cover 69.

A power input line 70 from the batteries 26 is provided and has a connection 71 extending to the pressure switch 65 and a connection 72 therefrom to the lamp 67 through a switch 73.

The line 70 is connected by a conductor 75 through a manually operable push button switch 76 accessible on the exterior of the control box 68 to a spark coil 77. A spark plug energizing line 78 extends from the spark coil 76 to the spark plug 51.

A thermocouple 80 is provided contiguous to the pilot 15 which is connected by a conductor 81 to a temperature operated switch 82 having a plurality of positions. The temperature operated switch 82 has an input conductor 83 connected to the power line 70. A lamp 84 is provided, visible at the front of the box 68, for indicating the "on" condition of the pilot 15 and is controlled by a switch 85. A lamp 86 is provided visible at the front of the box 68 for indicating the "off" condition of the pilot 15 and is controlled by a switch 87. The contacts of the switches 73, 85 and 87 are mechanically connected to a manual operator 79 for simultaneous actuation of the switches 73, 85 and 87 to prevent continuous energization of the lamps 67, 84 and 86 and reducing drain on the batteries 26.

The mode of operation will now be pointed out.

The gasoline engine 23 is started and operates the blower 22.

When it is desired to light the flame of the pilot 15 and with the valves 58 and 47 in adjusted positions to provide the proper mixture and with valve 34 open to supply gas through the pipe 33 and the pipe 17 to the pilot 15, the pushbutton 76 is momentarily closed. Upon closing of the pushbutton 76 the spark coil 77 is effective through the conductor 78 for activating the spark plug 51 to ignite the combustible mixture of the gas supplied through the pipe 46 and the air supplied through the pipe 55 at the ignition coupling 50. The flame transmitted through the pipe 18 is effective for igniting the flame at the pilot 15. The flame through the pipe 18 can travel long distances which may be as great as one to two thousand feet. At the same time, pilot failure, if this should occur, will be indicated by the thermocouple 80 through the conductor 81 to the temperature responsive switch 82 to indicate whether or not the pilot 15 is operating with a visual signal from the lamp 84 or the lamp 86. The simultaneous manual operation of the switches 73, 85 and 87 by the manual operator 79 will give the appropriate indication on the lamps 84 or 86 as to pilot operation and at the lamp 67 as to purge gas flow. The purge gas should not of course be flowing if waste combustible gas is being supplied to the header 11 but should be flowing if there is no waste combustible gas flow to the header 11. The purge gas flow acts with the fluidic seal 20 to prevent backflow and internal explosions.

Indication of the flow will be available on the differential pressure gage 60. The purge gas flow is ordinarily supplied to prevent the presence of oxygen from the air in the flare header 11 and the flare stack 10 when the pilot is in operation.

I claim:

1. An ignition system for flares comprising a flare stack, a pilot for igniting gas discharged from said flare stack, an igniter pipe extending to said pilot for directly initiating the operation of said pilot by flame propagation thereto, a portable source of electric energy, a source of fuel gas for ignition and for pilot gas supply, portable means for supplying air under pressure for admixture with fuel gas from said source and for delivery to said igniter pipe, an ignition coupling to which said source of gas and said means for supplying air are connected through manually controlled valves for said air and said gas and which is connected to said igniter pipe, said ignition coupling having a spark plug connected thereto energized by a spark coil, a manually operable switch connected to said source of electric energy and to said spark coil for energizing said spark plug for delivering a flame for propagation in said igniter pipe, and a fluid connection to said pilot from said source of fuel gas and having an air induction device therein.

2. An ignition system as defined in claim 1 in which an indicating means is provided for indicating the operating condition of said pilot, a temperature responsive member is located contiguous to said pilot, and said indicating means is responsive to said temperature responsive member.

3. An ignition system as defined in claim 1 in which a purge gas connection is provided for said flare stack, and said purge gas connection is in communication with said source of fuel gas.

4. An ignition system as defined in claim 1 in which said means for supplying air is a blower contiguous to said source of electrical energy.

5. An ignition system as defined in claim 4 in which said blower is gasoline motor driven.

6. An ignition system as defined in claim 2 in which said indicating means has manually controlled operating switches.

7. An ignition system as defined in claim 1 in which pressure indicating means is provided for said gas to said ignition coupling.

8. An ignition system as defined in claim 1 in which a purge gas connection is provided for said flare stack, and means is provided for measuring the pressure in said purge gas connection.

9. An ignition system as defined in claim 1 in which a purge gas connection is provided for said flare stack, and indicating means is provided for indicating the flow in said purge gas connection.

10. An ignition system as defined in claim 1 in which a purge gas connection is provided for said flare stack, and pressure responsive indicating means is provided responsive to the pressure in said purge gas connection.

11. An ignition system as defined in claim 1 in which said source of electrical energy and said means for supplying air under pressure comprise a combined portable component, and a panel is provided for supporting said ignition coupling, said valves and said manually operable switch.

12. An ignition system as defined in claim 1 in which said source of electrical energy comprises a storage battery, and a solar battery is provided for supplying electrical energy to said storage battery.

* * * * *